US006419393B1

(12) United States Patent
Shibata

(10) Patent No.: US 6,419,393 B1
(45) Date of Patent: Jul. 16, 2002

(54) BAG

(75) Inventor: Yukihiko Shibata, Nagoya (JP)

(73) Assignee: Daiwa Gravure Co., Ltd., Aichi-ken (JP)

( * ) Notice: Subject to any disclaimer, the term of this patent is extended or adjusted under 35 U.S.C. 154(b) by 0 days.

(21) Appl. No.: 09/644,325

(22) Filed: Aug. 23, 2000

(30) Foreign Application Priority Data

Aug. 26, 1999 (JP) ..... 11-239038
Jun. 23, 2000 (JP) ..... 2000-188552

(51) Int. Cl.[7] ..... B65D 30/08
(52) U.S. Cl. ..... 383/202; 222/82
(58) Field of Search ..... 383/202; 222/82, 222/83, 83.5

(56) References Cited

U.S. PATENT DOCUMENTS 3,935,993 A * 2/1976 Doyen et al. ..... 229/104
4,072,233 A * 2/1978 Kramer et al. ..... 206/245
5,421,485 A * 6/1995 Furuta et al. ..... 222/95
5,791,519 A * 8/1998 Van Marcke ..... 222/82
5,873,656 A * 2/1999 Arkins et al. ..... 383/20
6,164,825 A * 12/2000 Larkin et al. ..... 383/104

* cited by examiner

*Primary Examiner*—Stephen P. Garbe
(74) *Attorney, Agent, or Firm*—Fildes & Outland, P.C.

(57) ABSTRACT

It is an object of the present invention to provide a bag which is free from development of tears around a hole formed therein when pierced with tubular or hollow needle suction means. In accordance with the present invention, there is provided a bag for containing a liquid or powdery material, the bag comprising a penetrable portion to be pierced with tubular or hollow needle suction means for delivering the material out of the bag, the penetrable portion comprising a laminated sheet having an outer layer including at least one of a calendered film (e.g., aluminum foil) and a stretched film, and an inner layer of an unstretched film, wherein a peeling strength between the outer layer and the inner layer is 0.0490 to 3.4323 N/15 mm width.

6 Claims, 9 Drawing Sheets

BAG

FIELD OF THE INVENTION

The present invention relates to a bag for containing a liquid or powdery detergent or the like.

BACKGROUND OF THE INVENTION

Conventionally, liquid or powdery detergents for household use and the like are packed in plastic containers for sale. When the detergent in the container is used up, for example, a user may purchase a detergent refill packed in a plastic bag and refill the empty container with the detergent refill.

The user performs a refilling operation to pour the detergent refill into the empty container by holding the flexible plastic bag in hand. However, the plastic bag is so flexible that the mouth of the bag is positionally unstable, making it difficult to perform the refilling operation with the container and the bag brought into mouth-to-mouth contact with each other. Therefore, the user is likely to inadvertently spill the detergent out of the container.

One known approach to this problem is that a plastic bag containing a detergent refill is set in an empty container on the top of which is provided a liquid dispenser having a pump with a nozzle and a suction tube projecting downward from the pump and, with the bag being pierced with the tube, the detergent is delivered out of the bag through the nozzle by operating up and down the pump.

In this case, not only a portion of the bag to be pierced with the tube but the entire bag is formed of a laminated film comprising a stretched nylon film and a polyolefin film. The stretched nylon film is liable to be torn by a force exerted thereon when the bag is pierced with the tube. The polyolefin film laminated with the stretched nylon film is also torn along with the stretched nylon film by the piercing force when the bag is pierced with the tip of the tube. Thus, the laminated film is torn, so that air flows into the bag through tears developed in the laminated film around a hole through which the tube penetrates. When the detergent in the bag is reduced to a small quantity, the air is sucked out through the tube by the operation of the pump, thereby making it impossible to completely deliver the detergent out of the bag. Further, when the container falls down, the detergent may leak out of the bag through the tears within the container to make the inside of the container dirty, or leak out of the container.

DISCLOSURE OF THE INVENTION

To solve the aforesaid problems, it is an object of the present invention to provide a bag which is free from development of tears around a hole formed therein when pierced with tubular or hollow needle suction means.

In accordance with a first aspect of the present invention to achieve the aforesaid object, there is provided a bag for containing a liquid or powdery material, the bag comprising a penetrable portion to be pierced with tubular or hollow needle suction means for delivering the material out of the bag, the penetrable portion comprising a laminated sheet having an outer layer including at least one of a calendered film (e.g., aluminum foil) and a stretched film, and an inner layer of an unstretched film, wherein a peeling strength between the outer layer and the inner layer is 0.0490 to 3.4323 N/15 mm width.

The bag according to the first inventive aspect is preferably of a so-called stand-pack type (self-supporting type) having an outwardly bulged bottom portion and a body portion, the bottom portion serving as the penetrable portion to be pierced with the suction means, the body portion comprising a laminated sheet having an inner layer of an unstretched film, the unstretched film of the inner layer of the body portion and the unstretched film of the inner layer of the bottom portion being fusion-bonded along a seam between the body portion and the bottom portion by heat sealing.

In accordance with a second aspect of the present invention, there is provided a bag for containing a liquid or powdery material, the bag comprising a penetrable portion to be pierced with tubular or hollow needle suction means for delivering the material out of the bag, the penetrable portion comprising a laminated sheet having an outer layer including at least one of a calendered film (e.g., aluminum foil) and a stretched film, an intermediate layer of an unstretched film, and an inner layer of an unstretched film, wherein a peeling strength between the outer layer and the intermediate layer is 0.0490 to 3.4323 N/15 mm width, and a peeling strength between the intermediate layer and the inner layer is 0.0490 to 3.4323 N/15 mm width.

The bag according to the second inventive aspect is preferably of a so-called stand-pack type (self-supporting type) having an outwardly bulged bottom portion and a body portion, the bottom portion serving as the penetrable portion to be pierced with the suction means, the body portion comprising a laminated sheet having an inner layer of an unstretched film, the unstretched film of the inner layer of the body portion and the unstretched films of the intermediate and inner layers of the bottom portion being fusion-bonded along a seam between the body portion and the bottom portion by heat sealing.

In accordance with a third aspect of the present invention, there is provided a bag for containing a liquid or powdery material, the bag comprising a penetrable portion to be pierced with tubular or hollow needle suction means for delivering the material out of the bag, the penetrable portion comprising a laminated sheet having an outer layer of an unstretched film, an intermediate layer including at least one of a calendered film (e.g., aluminum foil) and a stretched film, and an inner layer of an unstretched film, wherein a peeling strength between the outer layer and the intermediate layer is 0.0490 to 3.4323 N/15 mm width, and a peeling strength between the intermediate layer and the inner layer is 0.0490 to 3.4323 N/15 mm width.

The bag according to the third inventive aspect is preferably of a so-called stand-pack type (self-supporting type) having an outwardly bulged bottom portion and a body portion, the bottom portion serving as the penetrable portion to be pierced with the suction means, the body portion comprising a laminated sheet having an inner layer of an unstretched film, the unstretched film of the inner layer of the body portion and the unstretched film of the inner layer of the bottom portion being fusion-bonded along a seam between the body portion and the bottom portion by heat sealing.

The bags according to the invention, for example, are each set within a container for use, and pierced with the suction means which extends from a liquid or powder dispenser of the container so that the liquid or powdery material can be delivered out of the bag through the suction means. In accordance with the first inventive aspect, the penetrable portion of the bag to be pierced with the suction means is formed of the laminated sheet having the outer layer including at least one of the calendered film (e.g., aluminum foil) and the stretched film and the inner layer of the unstretched film as described above. A preferred example of the stretched film for the outer layer is a stretched nylon film. since preventive measures is required against degradation of the material to be contained in the bag depending on the kind of the material, the calendered film, e.g., an aluminum foil is preferably employed which provides a barrier effect. An inner surface of the outer layer may be comprised of the unstretched film, e.g., an unstretched polyolefin film such as an unstretched polyethylene film. In this case, the unstretched film for the inner layer may also be an unstretched polyolefin film such as an unstretched polyethylene film, and the unstretched polyolefin film in the inner surface of the outer layer is opposed to the unstretched polyolefin film of the inner layer. When an edge portion of the unstretched polyolefin film of the inner layer of the bottom portion not intended to be pierced with the suction means is fusion-bonded to an edge portion of the polyolefin film of the inner layer of the body portion by heat sealing for joining the bottom portion and the body portion together, the edge portions of the unstretched polyolefin film in the inner surface of the outer layer and the unstretched polyolefin film of the inner layer of the bottom portion are also fusion-bonded together by the heat sealing.

Since the outer layer and the inner layer of the laminated sheet for the bottom portion of the bag are bonded to each other with a peeling strength of 0.0490 to 3.4323 N/15 mm width, the inner layer is easily separated from the outer layer when the laminated sheet is pierced with the suction means. The easy separation between the outer layer and the inner layer occurring when the laminated sheet is pierced with the suction means permits the inner layer to be disconnected from the outer layer thereby to prevent the inner layer from being torn even if at least one of the calendered film (aluminum foil) and the stretched film is torn by the piercing. Therefore, at least the inner layer is intimately fitted around the suction means which pierces into the bag, so that air is unlikely to flow into the bag. Even if the material contained in the bag is reduced to a small quantity, the material remaining in the bag can almost completely be delivered out of the bag.

According to the first inventive aspect, the peeling strength between the outer layer and the inner layer is 0.0490 to 3.4323 N/15 mm width as described above. If the peeling strength is lower than 0.0490 N/15 mm width, the outer layer and the inner layer of the laminated sheet are too easily separated from each other in handling the laminated sheet before the production of the bag, resulting in a poor operability. Where the inner surface of the outer layer is comprised of the unstretched film, however, delamination of the laminated sheet of the bottom portion along the seam between the bottom portion and the body portion of the finished bag is prevented even if the peeling strength is low. This is because the unstretched film in the inner surface of the outer layer and the unstretched film of the inner layer of the bottom portion are fusion-bonded to the unstretched film of the inner layer of the body portion along the seam by the heat sealing. Where the unstretched film is not provided in the inner surface of the outer layer, a peeling strength of greater than about 0.3432 N/15 mm width between the outer layer and the inner layer is required. If the peeling strength between the outer layer and the inner layer is higher than 3.4323 N/15 mm width, the inner layer is less liable to be separated from the outer layer when the bag is pierced with the suction means.

In accordance with the second inventive aspect, a preferred example of the stretched film for the outer layer is a stretched nylon film as in accordance with the first inventive aspect. Since preventive measures is required against degradation of the material to be contained in the bag depending on the kind of the material, a calendered film such as an aluminum foil is preferably employed which provides a barrier effect. An inner surface of the outer layer may be comprised of an unstretched film, e.g., an unstretched polyolefin film such as an unstretched polyethylene film. In this case, the unstretched film for the intermediate layer or the inner layer may also be an unstretched polyolefin film such as an unstretched polyethylene film, and the unstretched polyolefin film of the intermediate layer is opposed to the unstretched polyolefin film in the inner surface of the outer layer and to the unstretched polyolefin film of the inner layer. When an edge portion of the unstretched polyolefin film of the inner layer of the bottom portion not intended to be pierced with the suction means is fusion-bonded to an edge portion of the polyolefin film of the inner layer of the body portion by heat sealing for joining the bottom portion and the body portion together, the edge portions of the unstretched polyolefin film in the inner surface of the outer layer, the unstretched polyolefin film of the intermediate layer and the unstretched polyolefin film of the inner layer of the bottom portion are also fusion-bonded together by the heat sealing.

Where the unstretched film is not provided in the inner surface of the outer layer, the intermediate layer is comprised of a laminated film including an unstretched polyolefin film provided on an inner side thereof and another unstretched film such as an unstretched nylon film, and the unstretched polyolefin film of the intermediate layer is opposed to the unstretched polyolefin film of the inner layer. When an edge portion of the unstretched polyolefin film of the inner layer of the bottom portion not intended to be pierced with the suction means is fusion-bonded to an edge portion of the polyolefin film of the inner layer of the body portion by heat sealing for joining the bottom portion and the body portion together, the edge portions of the unstretched polyolefin film of the intermediate layer and the unstretched polyolefin film of the inner layer of the bottom portion are also fusion-bonded together by the heat sealing.

In the laminated sheet according to the second inventive aspect, the outer layer and the inner layer are each bonded to the intermediate layer with a peeling strength of 0.0490 to 3.4323 N/15 mm width as described above. Therefore, the intermediate layer is easily separated from the inner layer and from the outer layer when the laminated sheet is pierced with the suction means. The peeling strength between the outer layer and the intermediate layer and the peeling strength between the intermediate layer and the inner layer are each set in the range of 0.0490 to 3.4323 N/15 mm width for the following reason. If the peeling strength is lower than 0.0490 N/15 mm width, the outer layer, the intermediate layer and the inner layer of the laminated sheet are too easily separated from one another in handling the laminated sheet before the production of the bag, resulting in a poor operability. Where the unstretched film is provided in the inner surface of the outer layer, however, delamination of the laminated sheet of the bottom portion along the seam between the bottom portion and the body portion of the finished bag is prevented even if the peeling strength is low. This is because the unstretched film in the inner surface of the outer layer, the unstretched film of the intermediate layer and the unstretched film of the inner layer of the bottom portion are fusion-bonded together to the unstretched film of the inner layer of the body portion along the seam by the heat sealing. Where the unstretched film is not provided in the inner surface of the outer layer, a peeling strength of 0.3432 to 3.4323 N/15 mm width between the outer layer and the intermediate layer is required. If the peeling strength between the outer layer and the intermediate layer or between the intermediate layer and the inner layer is higher than 3.4323 N/15 mm width, the intermediate layer is less liable to be separated from the outer layer and from the inner layer when the bag is pierced with the suction means. The easy separation between the outer layer and the intermediate layer and between the intermediate layer and the inner layer occurring when the laminated sheet is pierced with the suction means permits the outer layer, the intermediate layer and the inner layer to be disconnected from one another at two stages. If the outer layer is torn by the piercing, the intermediate layer is disconnected from the outer layer thereby to be prevented from being torn, and the inner layer is disconnected from the intermediate layer thereby to be prevented from being torn. Even if the intermediate layer happens to be torn, the inner layer is prevented from being torn. Further, even if the inner layer happens to be torn with no tear in the intermediate layer, at least the inner layer or the intermediate layer is intimately fitted around the suction means which pierces into the bag, so that air is unlikely to flow into the bag. Therefore, if the material contained in the bag is reduced to a small quantity, the material remaining in the bag can almost completely be delivered out of the bag.

The bag according to the third inventive aspect is constructed such that the film structure of the outer layer and the film structure of the intermediate layer in the bag according to the second inventive aspect are interchanged with each other. More specifically, the outer layer is comprised of a laminated film including an unstretched polyolefin film and another unstretched film, e.g., an unstretched nylon film, and the intermediate layer includes at least one of a calendered film such as an aluminum film and an unstretched film. The other features of the construction of the bag is the same as those according to the second inventive aspect. In accordance with the third inventive aspect, the intermediate layer is easily separated from the outer layer and from the inner layer.

Therefore, the outer layer, the intermediate layer and the inner layer are disconnected from one another at two stages. If the intermediate layer is torn by the piercing with the suction means, the outer layer is disconnected from the intermediate layer thereby to be prevented from being torn, and the inner layer is disconnected from the intermediate layer thereby to be prevented from being torn. Even if the outer layer happens to be torn, the inner layer is prevented from being torn. Further, even if the inner layer happens to be torn with no tear in the outer layer, at least the inner layer or the outer layer is intimately fitted around the suction means which pierces into the bag, so that air is unlikely to flow into the bag. Therefore, if the material contained in the bag is reduced to a small quantity, the material remaining in the bag can almost completely be delivered out of the bag.

The bags for the liquid or powdery material according to the first to third inventive aspects may be of a so-called stand-pack type (self-supporting type) which is to be set upside down in the container as described above, of a pillow type, of a three side seal type, of a four side seal type, of a tetra-pack type, or of a gusset type which has four faces with longitudinally opposite side edges thereof closed by heat sealing and is inserted in the container with longitudinally opposite portions thereof folded toward each other to centrally gather the liquid or powdery material contained therein. In the bags of any of the aforesaid types, the penetrable portion to be pierced with the suction means projecting from the liquid or powder dispenser is formed of the double-layer laminated sheet having the outer layer and the inner layer or of the triple-layer laminated sheet having the outer layer, the intermediate layer and the inner layer. The present invention is also applicable to a bag for containing an ink for a printer or the like. In this case, the hollow needle suction means is employed instead of the tubular suction means for piercing into the ink bag set in the printer or the like. With one end of the needle suction means inserted into the ink bag, the ink is delivered out of the ink bag from the other end of the needle suction means. It is noted that the peeling strength as set forth in the first to third inventive aspects is determined in conformity with the test method for heat-seal peeling strength specified in JIS K 6854.

With the construction according to the first inventive aspect, the outer layer and the inner layer are bonded to each other with a peeling strength of 0.0490 to 3.4323 N/15 mm width, so that the inner layer is easily separated from the outer layer when the laminated sheet is pierced with the tubular or needle suction means. The easy separation between the outer layer and the inner layer occurring when the laminated sheet is pierced with the suction means permits the inner layer to be disconnected from the outer layer thereby to prevent the inner layer from being torn even if at least one of the calendered film (aluminum foil) and the stretched film is torn by the piercing. Therefore, at least the inner layer is intimately fitted around the suction means which pierces into the bag, so that air is unlikely to flow into the bag. Even if the material contained in the bag is reduced to a small quantity, the material remaining in the bag can almost completely be delivered out of the bag. With the constructions according to the second and third inventive aspects, the outer layer and the inner layer are each bonded to the intermediate layer with a peeling strength of 0.0490 to 3.4323 N/15 mm width, so that the intermediate layer is easily separated from the outer layer and from the inner layer when the laminated sheet is pierced with the suction means. The easy separation between the outer layer and the intermediate layer and between the intermediate layer and the inner layer occurring when the laminated sheet is pierced with the suction means permits the outer layer, the intermediate layer and the inner layer to be disconnected from one another at two stages. Even if one of the outer layer and the intermediate layer is torn by the piercing with the suction means, the other layer is disconnected from the one layer thus torn thereby to be prevented from being torn, and the inner layer is disconnected from the intermediate layer thereby to be prevented from being torn. Even if the outer layer and the intermediate layer happen to be torn, the inner layer is prevented from being torn. Further, even if the inner layer happens to be torn with no tear in the intermediate layer or the outer layer, at least one of the inner layer, the intermediate layer and the outer layer is intimately fitted around the suction means which pierces into the bag, so that air is unlikely to flow into the bag. Therefore, if the material contained in the bag is reduced to a small quantity, the material remaining in the bag can almost completely be delivered out of the bag.

DETAILED DESCRIPTION OF THE EMBODIMENTS

FIGS. 1 to 4 illustrate a first embodiment of the present invention.

Figure 1:
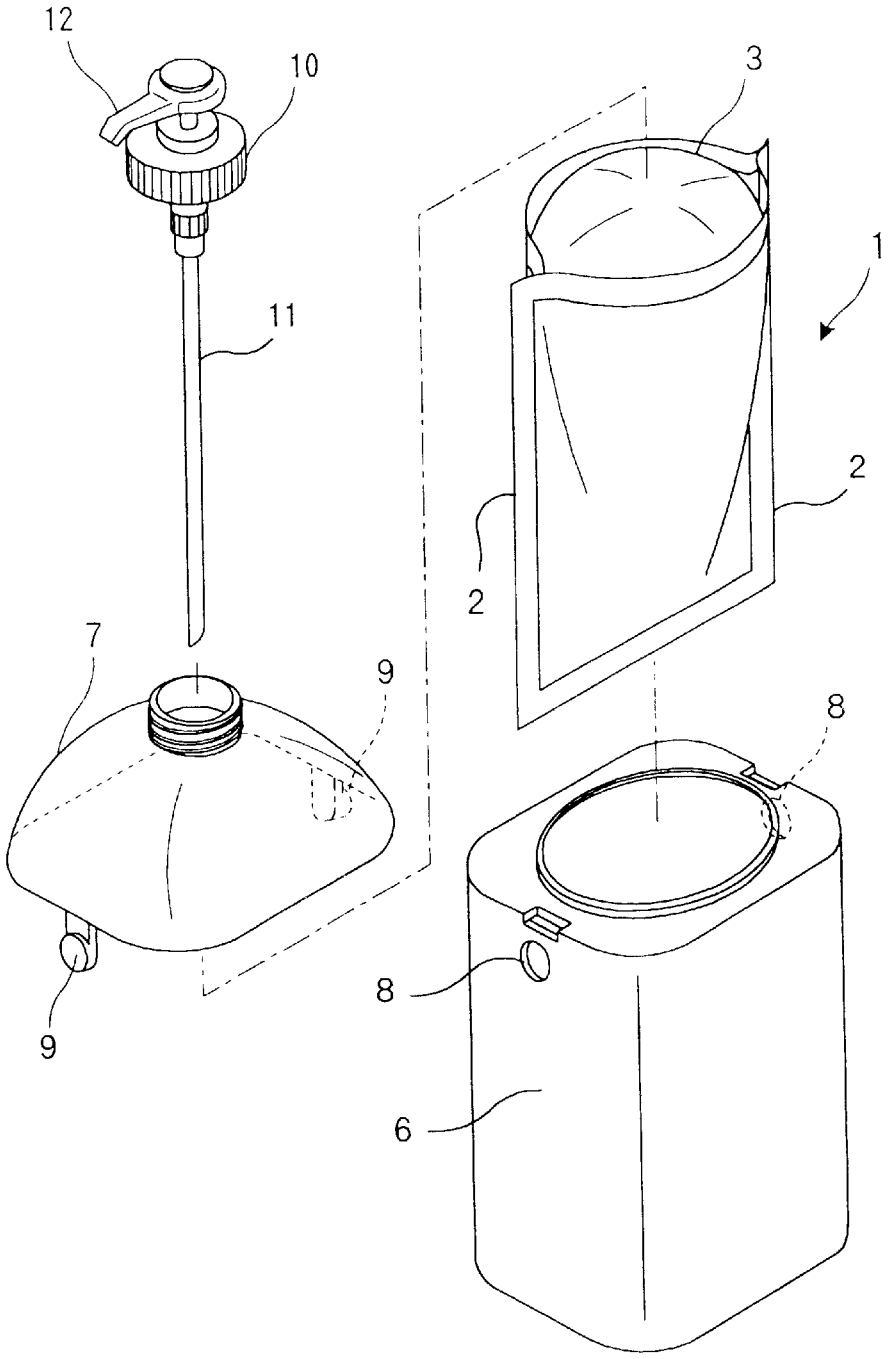
FIG. 1 is an exploded perspective view illustrating a bag according to a first embodiment of the present invention, and a container having a container body and a cover.
Figure 2:
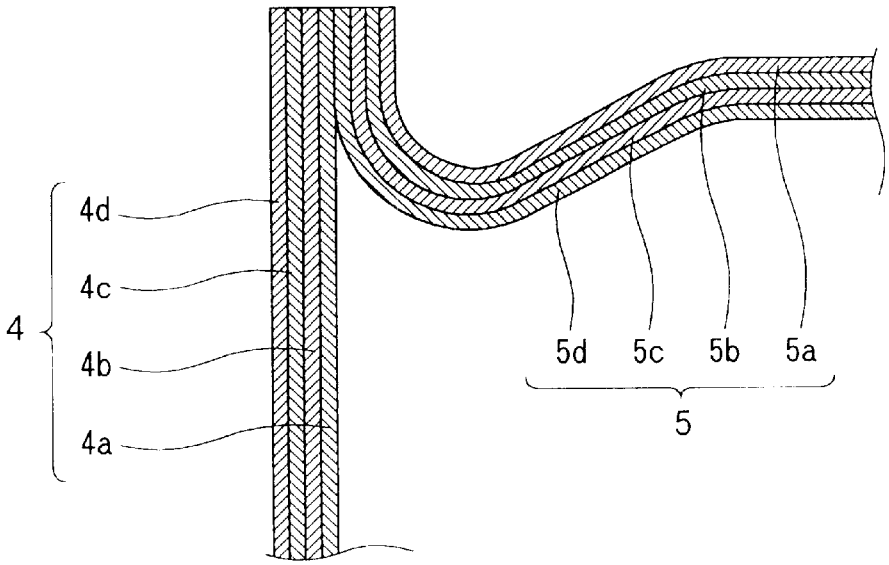
FIG. 2 is an enlarged sectional view illustrating a major portion of the bag.
Figure 3:
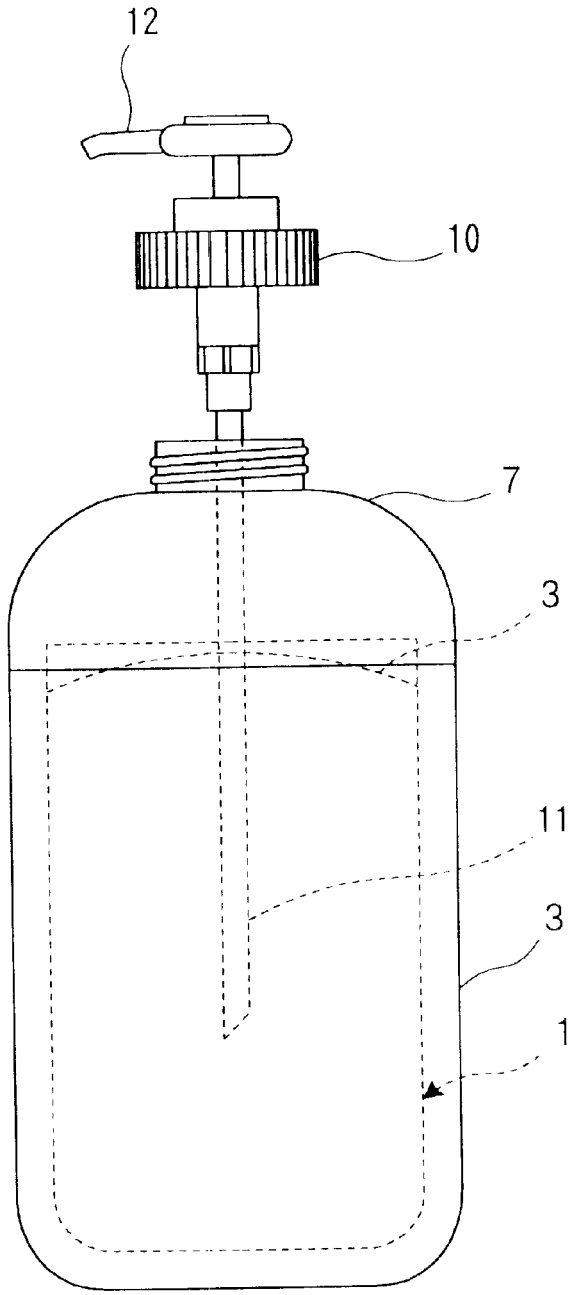
FIG. 3 is a front view illustrating the container with the cover attached to the container body and with the bag set in the container body.
Figure 4:
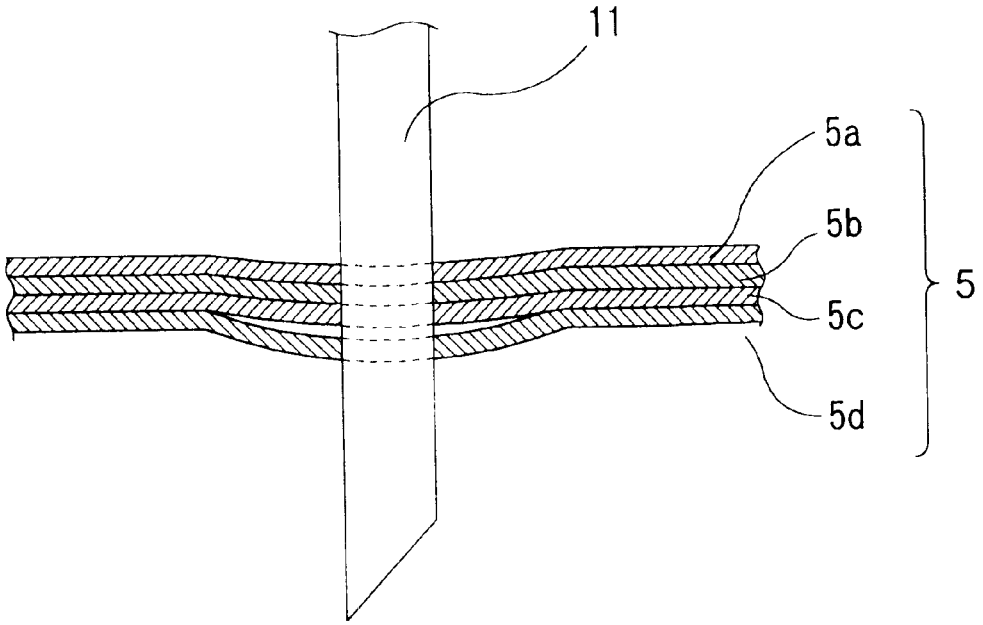
FIG. 4 is an enlarged sectional view illustrating a major portion of the bag with a laminated sheet thereof being pierced with a tube.

Referring to FIGS. 1 to 4, a bag 1 for containing a liquid material such as a detergent is of a so-called stand-pack (self-supporting) configuration, which includes a body portion having sealed portions 2, 2 formed by heat sealing along at least two opposite side edges thereof and an outwardly bulged bottom portion 3. It is noted that the bag 1 is illustrated upside down in FIGS. 1 to 4. As shown in FIG. 2, the body portion of the bag 1 is formed of a laminated sheet 4 having an unstretched polyolefin film ply 4*a* such as an unstretched polyethylene film, a stretched nylon film ply 4*b*, a barrier ply 4*c* of an aluminum foil and a polyethylene terephthalate film ply 4*d* arranged in this order from the inner side thereof. The bottom portion 3 is formed of a laminated sheet 5 having an outer layer including a stretched nylon film ply 5*a*, a barrier ply 5*b* of an aluminum foil and an unstretched polyolefin film ply 5*c* such as of an unstretched polyethylene film arranged in this order from the outer side thereof, and an inner layer of an unstretched polyolefin film ply 5*d* such as an unstretched polyethylene film. The outer layer and the inner layer of the bottom portion 3 are heat-bonded to each other with a peeling strength of 0.0490 to 0.9807 N/15 mm width. Then, the unstretched polyolefin film ply 4*a* of the body portion and the unstretched polyolefin film plies 5*c*, 5*d* of the bottom portion are fusion-bonded along their edges by heat sealing to form the bag 1 of the stand-pack configuration.

A reference numeral 6 denotes a plastic container body of a vertically elongated shape having an open top through which the bag 1 containing the liquid material (e.g., detergent) is inserted upside down in the container body with the bottom portion 3 thereof facing upward. The open top of the container body 6 is closed with a plastic cover 7 made of the same plastic material as the container body 6. The container body 6 has apertures 8, 8 formed in opposite side faces thereof adjacent upper edges thereof. Hook pieces 9, 9 downstanding from the cover 7 are brought into engagement with the apertures 8, 8 from upper inward sides, so that the container body 6 and the cover 7 are joined together. The cover 7 is fitted with a pump 10 which serves as a liquid dispenser. A tubular suction member 11 projecting downward from the pump 10 pierces through the bottom portion 3 with a lower end thereof located adjacent a lower edge of the bag 1. More specifically, the tubular suction member 11 is a rigid tube formed of a medium-density polyethylene or polypropylene, and has an obliquely cut sharp tip for piercing through the bottom portion 3 of the bag 1. Since the bottom portion 3 of the bag 1 is formed of the laminated sheet having the outer layer including the stretched nylon film ply 5*a*, the aluminum foil barrier ply 5*b* and the unstretched polyolefin film ply 5*c* (e.g., unstretched polyethylene film), and the inner layer of the unstretched polyolefin film 5*d* (e.g., unstretched polyethylene film) located inwardly of the outer layer, the bottom portion 3 of the bag 1 is not torn across the entire width thereof when pierced with the tube 11, but the tube 11 is intimately fitted in a hole formed in the bottom portion 3 by the piercing. A reference numeral 12 denotes a nozzle attached to the pump 10 as a liquid outlet for delivering the liquid material drawn up through the tube 11 out of the bag. When the bag 1 is to be set upside down in the container body 6, the bag 1 is squeezed by folding the opposite side portions and lower portion thereof so that the liquid material within the bag 1 is centrally gathered to flatly stretch the bottom portion 3 of the bag 1 located on the upper side in the inverted state. The container body 6 has an internal size predetermined so as to permit the bag 1 to maintain such a condition when the bag 1 is set in the container body 6.

Next, an explanation will be given to how to use the bag of the aforesaid construction. The bag 1 of the stand-pack type containing the liquid material (e.g., detergent for household use) is first set upside down in the container body 6. At this time, the bag 1 is squeezed by folding the opposite side portions and lower portion thereof so that the liquid material within the bag 1 is centrally gathered to flatly stretch the bottom portion 3 of the bag 1 located on the upper side in the inverted state. When the cover 7 is attached to the top of the container body 6, the bottom portion 3 of the bag 1 thus flatly stretched is easily pierced with the tube 11 of the pump 10. After the cover 7 is attached to the top of the container body 6 with the bottom portion 3 of the bag 1 pierced with the tube 11, the pump 10 is threadingly engaged with an upper portion of the cover 7. By depressing a head of the pump 10 and then allowing it to rise back, the liquid material is drawn up through the tube 11 from the bag 1. This operation is repeated, whereby the liquid material is intermittently delivered out of the nozzle 12. As described above, the bottom portion 3 of the bag 1 is formed of the laminated sheet having the outer layer including the stretched nylon film ply 5*a*, the aluminum foil barrier ply 5*b* and the unstretched polyolefin film ply 5*c* arranged in this order from the outer side and the inner layer of the unstretched polyolefin film ply 5*d* provided on the inner side of the outer layer, and the outer layer and the inner layer are bonded to each other with a peeling strength of 0.0490 to 0.9807 N/15 mm width. Therefore, the inner layer is separated from the outer layer when the bottom portion 3 of the bag 1 is pierced with the tube 1. The bottom portion 3 of the bag 1 is not torn, but intimately fitted around the tube 11 (see FIG. 4), so that air is unlikely to flow into the bag 1. Therefore, even if the liquid material within the bag 1 is reduced to a small quantity, the liquid material can completely be delivered out of the bag 1. Even if the container body 6 falls down, the liquid material does not leak out of the bag 1 within the container body 6.

In order to determine the possibility of liquid leakage from the part of the bottom portion 3 of the bag 1 pierced with the tube 11, a compression resistance test was performed in conformity with "Food Additive Standards, Paragraph 3, Utensil and Container Packaging, B-2, Pressure Testing" specified by the Japanese Food Sanitation Law by applying a load of 60 kg to a side portion of the bag 1. As a result, no liquid leakage was detected.

Figure 5:
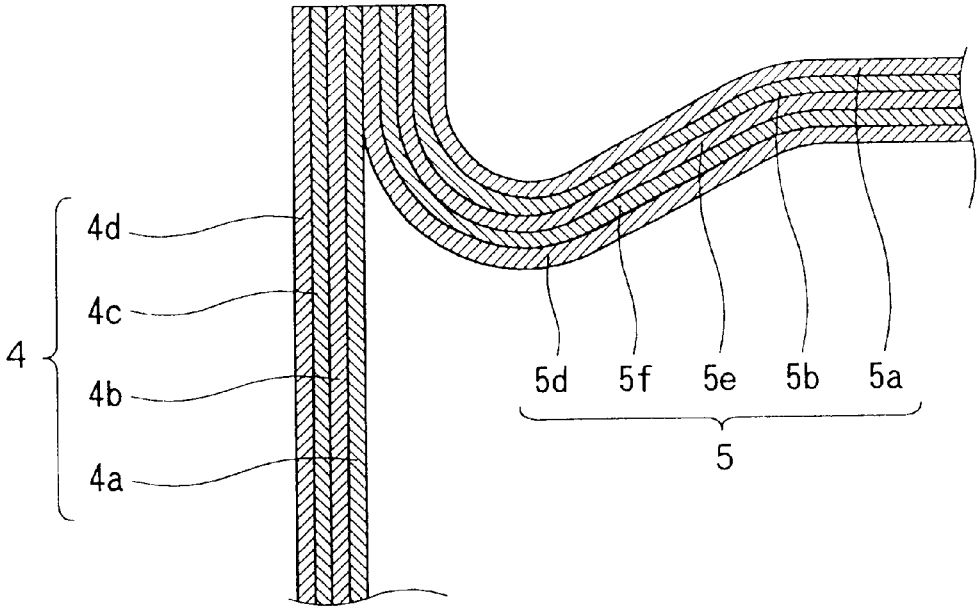
FIG. 5 is an enlarged sectional view illustrating a major portion of a bag according to a second embodiment of the invention.
Figure 6:
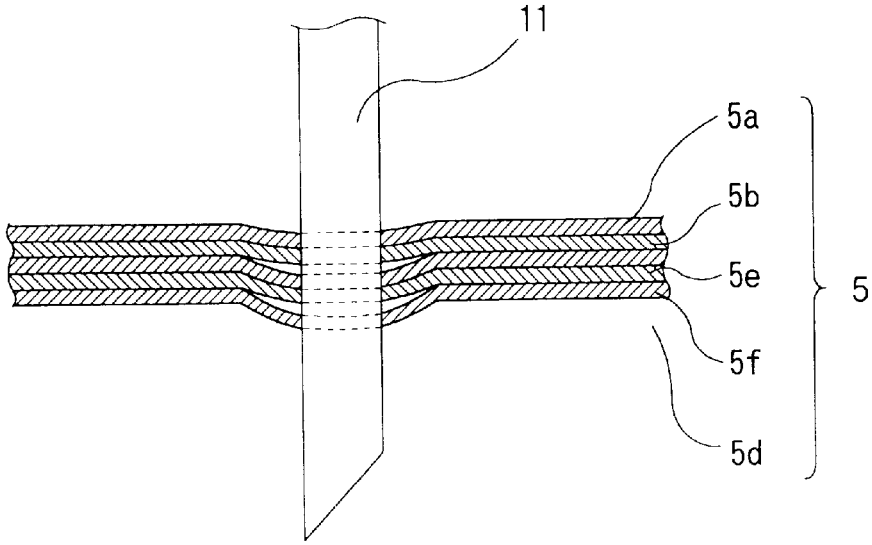
FIG. 6 is an enlarged sectional view illustrating a major portion of the bag with a laminated sheet thereof being pierced with the tube.

FIGS. 5 and 6 illustrate a second embodiment of the present invention. A bag 1 of the second embodiment has substantially the same construction as the bag 1 of the first embodiment except for the following points. Therefore, like components are denoted by like reference characters.

Referring to FIGS. 5 and 6, the bottom portion 3 of the bag 1 is formed of a laminated sheet 5 having an outer layer including a stretched nylon film ply 5*a* and a barrier ply 5*b* of an aluminum foil located on the inner side, an intermediate layer including an unstretched nylon film ply 5*e* and an unstretched polyolefin film ply 5*f* such as an unstretched polyethylene film located on the inner side, and an inner layer of an unstretched polyolefin film ply 5*d* such as an unstretched polyethylene film. The unstretched polyolefin film plies 5*d*, 5*f* of the bottom portion and the polyolefin film ply 4*a* of the body portion are fusion-bonded along their edges by heat sealing to form the bag 1 of the stand-pack configuration. In the second embodiment, the outer layer is bonded to the intermediate layer with a peeling strength of 0.3432 to 3.4323 N/15 mm width by an adhesive, and the intermediate layer is heat-bonded to the inner layer with a peeling strength of 0.0490 to 0.9807 N/15 mm width.

An explanation will next be given to how to use the bag of the aforesaid construction. The bag 1 of the stand-pack type is set upside down in the container body as in the first embodiment. Then, the bottom portion 3 of the bag 1 is pierced with the tube 11. As described above, the bottom portion 3 of the bag 1 is formed of the laminated sheet having the outer layer including the stretched nylon film ply 5*a* and the aluminum foil barrier ply 5*b* located on the inner side, the intermediate layer having the unstretched nylon film ply 5*e* and the unstretched polyolefin film ply 5*f* located on the inner side, and the inner layer of the unstretched polyolefin film 5*d*, and the intermediate layer is bonded to the outer layer with a peeling strength of 0.3432 to 3.4323 N/15 mm width and to the inner layer with a peeling strength of 0.0490 to 0.9807 N/15 mm width. Therefore, the intermediate layer is separated from the outer layer and from the inner layer when the bottom portion 3 of the bag 1 is pierced with the tube 11. Therefore, the bottom portion 3 of the bag 1 is not torn, but intimately fitted around the tube 11 (see FIG. 6), so that air is unlikely to flow into the bag 1. Even if the liquid material within the bag 1 is reduced to a small quantity, the liquid material can completely be delivered out of the bag 1. Further, even if the container body falls down, the liquid material does not leak out of the bag 1 within the container body. Particularly, even if the outer layer including the stretched film is torn around a hole formed therein by piercing the bottom portion 3 of the bag 1 with the tube 11, the intermediate layer including the unstretched film which is less liable to be torn is separated from the outer layer when pierced with the tube 11. Therefore, the intermediate layer including the unstretched film is not torn around a hole formed therein by the piercing, but intimately fitted around the tube 11. Further, even if the intermediate layer happens to be torn around the hole, the unstretched film of the inner layer which is less liable to be torn is separated from the intermediate layer when pierced with the tube 11. Therefore, the inner layer is not torn around a hole formed therein by the piercing, but intimately fitted around the tube 11.

In order to determine the possibility of liquid leakage from the part of the bottom portion 3 of the bag 1 pierced with the tube 11, a compression resistance test was performed in the same manner as in the first embodiment in conformity with "Food Additive Standards, Paragraph 3, Utensil and Container Packaging, B-2, Pressure Testing" specified by the Japanese Food Sanitation Law by applying a load of 60 kg to a side portion of the bag 1. As a result, no liquid leakage was detected.

The construction of the pump 10 attached to the container body 6 in the aforesaid two embodiments is not limited to that shown in the figures. A member having a liquid delivery outlet and a tube with no pumping function may be employed instead of the pump.

Besides the detergent for household use, liquid seasonings such as oil and soy source, milk, juice, and highly viscous liquid materials such as a hair shampoo, a hair conditioning agent and a hair treatment agent may be employed as the liquid material to be delivered out of the bag set in the container body 6.

Figure 7:
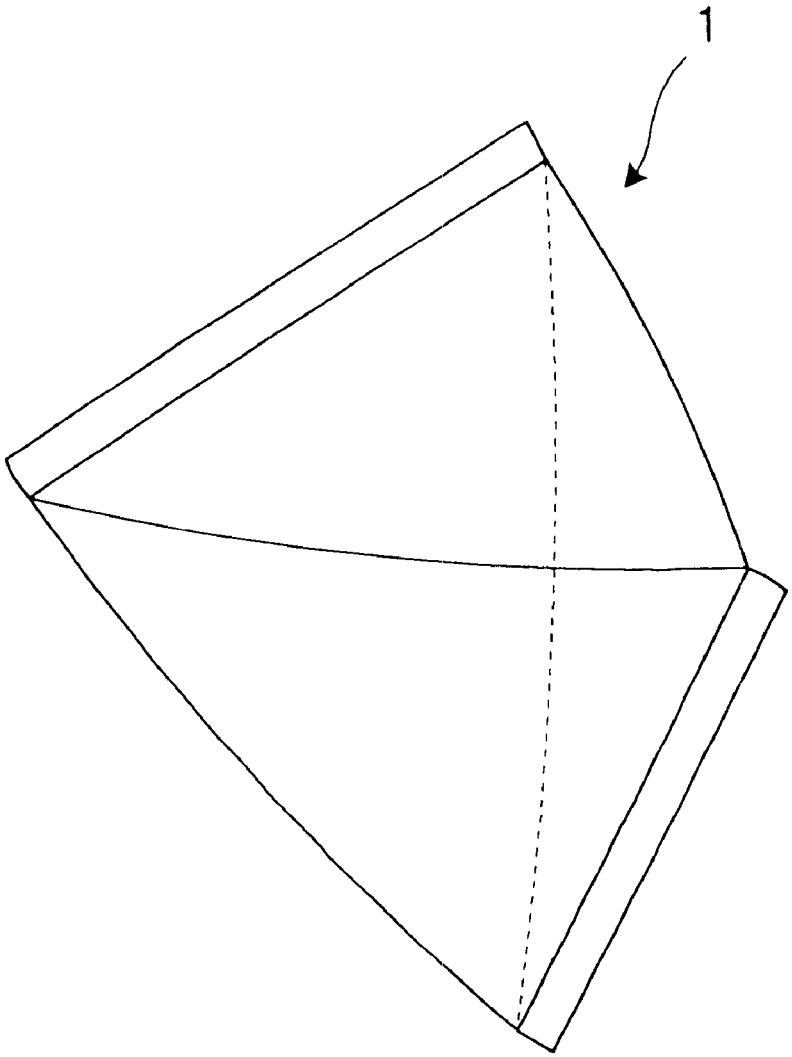
FIG. 7 is a perspective view illustrating a bag according to a third embodiment of the invention.
Figure 8:
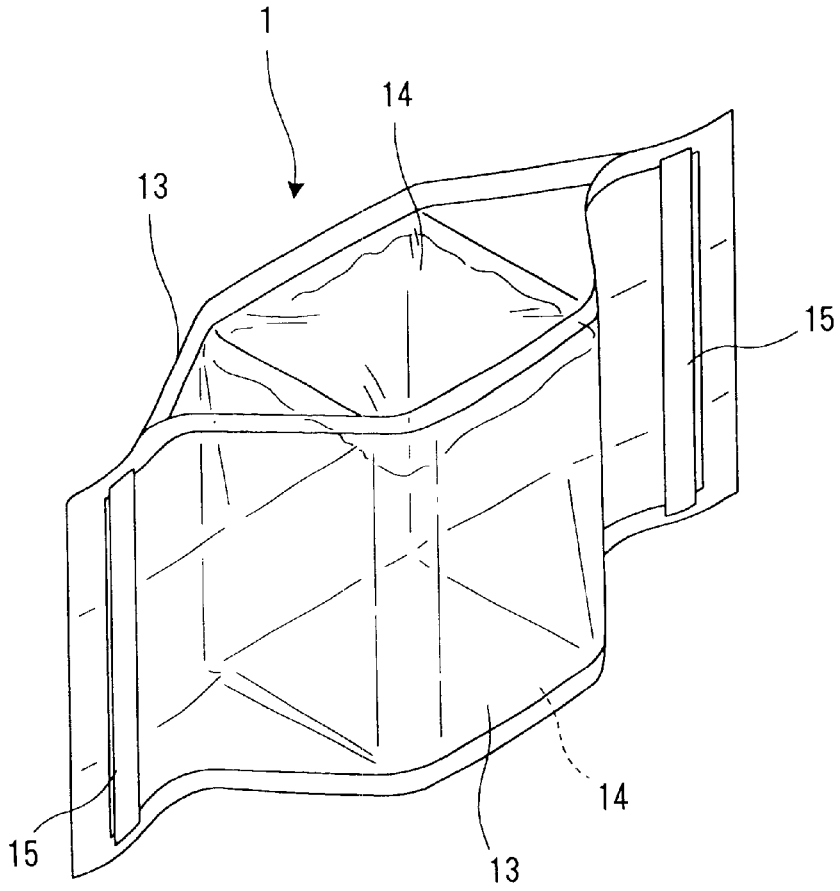
FIG. 8 is a perspective view illustrating a bag according to a fourth embodiment of the invention.

Although the bags 1 according to the aforesaid two embodiments are of the stand-pack type, the present invention may be embodied as a bag of a so-called tetra-pack type as shown in FIG. 7 or as a bag of a so-called gusset type which has four faces with longitudinally opposite edges thereof heat-sealed as shown in FIG. 8.

The bag 1 of the tetra-pack type shown in FIG. 7 is adapted to be set in the container body with one face thereof facing upward. At least the face portion of the bag 1 facing upward is formed of a laminated sheet 5, as shown in FIG. 2, having an outer layer including a stretched nylon film ply 5*a*, a barrier ply 5*b* of an aluminum foil and an unstretched polyolefin film ply 5*c* arranged in this order from the outer side, and an inner layer of an unstretched polyolefin film ply 5*d* or, alternatively, formed of a laminated sheet 5, as shown in FIG. 5, having an outer layer including a stretched nylon film ply 5*a* and a barrier ply 5*b* of an aluminum foil located on the inner side, an intermediate layer including an unstretched nylon film ply 5*e* and an unstretched polyolefin film ply 5*f* located on the inner side, and an inner layer of an unstretched polyolefin film ply 5*d*. The other face portions of the bag are each formed of a laminated sheet 4 having an unstretched polyolefin film ply 4*a*, a stretched nylon film ply 4*b*, a barrier ply 4*c* of an aluminum foil and a polyethylene terephthalate film ply 4*d* arranged in this order from the inner side.

The bag 1 of the gusset type shown in FIG. 8 is produced by using a pair of larger sheets 13 and a pair of smaller sheets 14 which are identical in length but different in width. For the production of the gusset-type bag, the larger sheets 13 and the smaller sheets 14 are alternately connected to one another in a longitudinally flush relation with their longitudinal edges heat-sealed to form a tubular body. Then, the smaller sheets 14, 14 are inwardly folded along their widthwise medial lines to collapse the tubular body. One of longitudinally opposite open sides of the collapsed tubular body is closed by heat sealing and, after a liquid material such as a detergent is poured into the resulting tubular body from the other open side, the other side of the tubular body is closed by heat sealing. Thus, the gusset-type bag having four faces is provided.

Figure 9:
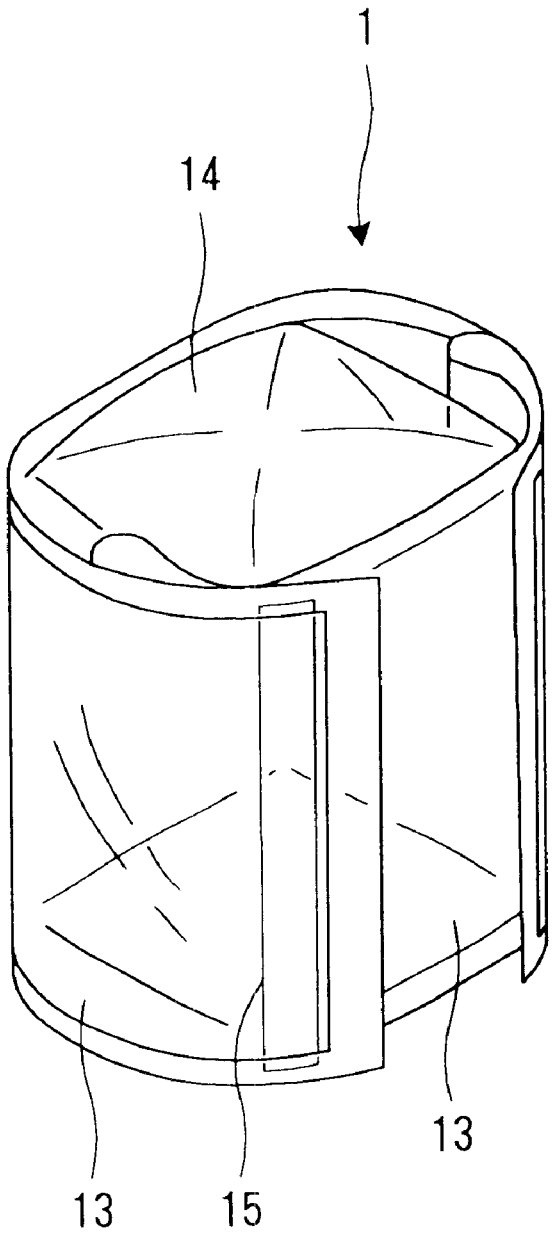
FIG. 9 is a perspective view illustrating the bag which is ready to be set in the container body.

One of the smaller sheets 14 is formed of a laminated sheet 5, as shown in FIG. 2, having an outer layer including a stretched nylon film ply 5*a*, a barrier ply 5*b* of an aluminum foil and an unstretched polyolefin film ply 5*c* arranged in this order from the outer side, and an inner layer of an unstretched polyolefin film ply 5*d* or, alternatively, formed of a laminated sheet 5, as shown in FIG. 5, having an outer layer including a stretched nylon film ply 5*a* and a barrier ply 5*b* of an aluminum foil located on the inner side, an intermediate layer including an unstretched nylon film ply 5*e* and an unstretched polyolefin film ply 5*f* located on the inner side, and an inner layer of an unstretched polyolefin film ply 5*d*. The other smaller sheet 14 and the pair of larger sheets 13, 13 of the bag 1 are each formed of a laminated sheet having an unstretched polyolefin film ply, a stretched nylon film ply, a barrier ply of an aluminum foil and a stretched polyethylene terephthalate ply arranged in this order from the inner side. The bag 1 thus constructed is fitted with double-sided adhesive tapes 15, 15, which are applied on outer surface portions of one of the larger sheets 13 adjacent the longitudinally opposite edges thereof. The bag 1 containing the liquid material (e.g., detergent for household use) is set in the container body with the one smaller sheet 14 facing upward. At this time, longitudinally opposite side portions of the bag 1 are folded toward each other, overlapped with the one larger sheet 13 and bonded to each other with the double-sided adhesive tapes 15, 15 as shown in FIG. 9, so that the liquid material is centrally gathered within the bag 1. Thus, the smaller sheets 13 are stretched under the internal pressure of the bag 1, so that the one smaller sheet 13 to be located on the upper side is more easily pierced with the tube 11 of the pump 10.

While the present invention has thus been described by way of the embodiments thereof, the configuration of the bag 1 is not limited to those described above. The present invention is applicable, for example, to bags of a pillow type, of a three side seal type and of a four side seal type, and a flexible bag having a cup-shaped body portion with its open top covered with a sheet to be pierced with the tube 11. What is important is that at least the portion of the bag to be pierced with the tube 11 is formed of a laminated sheet having an outer layer including at least one of a calendered film such as an aluminum foil and a stretched film and an inner layer of an unstretched film, and the peeling strength between the outer layer and the inner layer of the laminated sheet is 0.0490 to 3.4323 N/15 mm width, or that at least the portion of the bag to be pierced with the tube 11 is formed of a laminated sheet having an outer layer including at least one of a calendered film such as an aluminum foil and a stretched film, an intermediate layer of an unstretched film and an inner layer of an unstretched film, and the peeling strength between the outer layer and the intermediate layer and the peeling strength between the intermediate layer and the inner layer are each in the range of 0.0490 to 3.4323 N/15 mm width. The structure of the laminated sheet including the outer and inner layers or the outer, intermediate and inner layers is not limited to those described in the aforesaid embodiments. In the case of the laminated sheet including the outer and inner layers, it is merely necessary that the outer layer and the inner layer are bonded to each other with a peeling strength of 0.0490 to 3.4323 N/15 mm width. In the case of the laminated sheet including the outer, intermediate and inner layers, it is merely necessary that the outer layer and the inner layer are each bonded to the intermediate layer with a peeling strength of 0.0490 to 3.4323 N/15 mm width. Further, the laminated sheet may be constructed such that the outer layer includes an unstretched film and the intermediate layer includes at least one of a calendered film such as an aluminum foil and a stretched film. In this case, the peeling strengths between the respective layers may be variably set within the aforesaid range depending on the structures of the outer layer and the intermediate layers.

Where the portion of the bag not intended to be pierced with the tube 11 is formed of a stretched nylon film or a stretched polyethylene terephthalate film as in the aforesaid embodiments, the bag has an improved drop impact resistance. Although the bags according to the aforesaid embodiments are adapted to contain the liquid material, the present invention is applicable to a bag for a powdery material. Further, the bags according to the aforesaid embodiments are each adapted to be pierced with the tube 11 from the upper side thereof with the portion thereof to be pierced with the tube 11 facing upward. However, the present invention is not limited to such an arrangement, but the bag may be adapted to be pierced with the tube 11 from the lateral side or lower side thereof with the portion thereof to be pierced with the tube 11 facing sideward or downward.

Although the barrier layers 4*c*, 5*c* are each composed of an aluminum foil in the aforesaid embodiments, other examples of the barrier layers include an aluminum- or silica-deposited film, an ethylene-vinyl alcohol copolymer film and a polyvinylidene chloride film.

Further, the present invention is applicable to a bag for containing an ink for a printer or the like. In this case, the container body 6, the pump 10 and the like shown in FIG. 1 are not used, but hollow needle suction means is employed instead of the tube for piercing into the ink bag set in the printer or the like. With one end of the needle suction means inserted into the ink bag, the ink is delivered out of the ink bag from the other end of the needle suction means.

What is claimed is:

1. A bag for containing a liquid or powdery material, the bag comprising a penetrable portion to be pierced with a tubular or hollow needle for delivering the material out of the bag, the penetrable portion comprising a laminated sheet having an outer layer including at least one of a calendered film and a stretched film, and an inner layer of an unstretched film, wherein a peeling strength between the inner layer and the outer layer is 0.0490 to 3.4323 N/15 mm width.

2. A bag as set forth in claim 1, which is of a self-supporting type having an outwardly bulged bottom portion and a body portion, the bottom portion serving as the penetrable portion to be pierced with the needle, the body portion comprising a laminated sheet having an inner layer of an unstretched film, the unstretched film of the inner layer of the body portion and the unstretched film of the inner layer of the bottom portion and the unstretched film of the inner layer being fusion-bonded along a seam between the body portion and the bottom portion by heat sealing.

3. A bag for containing a liquid or powdery material, the bag comprising a penetrable portion to be pierced with a tubular or hollow needle for delivering the material out of the bag, the penetrable portion comprising a laminated sheet having an outer layer including at least one of a calendered film and a stretched film, an intermediate layer of an unstretched film, and an inner layer of an unstretched film, wherein a peeling strength between the outer layer and the intermediate layer is 0.0490 to 3.4323 N/15 mm width, and a peeling strength between the intermediate layer and the inner layer is 0.0490 to 3.4323 N/15 mm width.

4. A bag as set forth in claim 3, which is of a self-supporting type having an outwardly bulged bottom portion and a body portion, the bottom portion serving as the penetrable portion to be pierced with the needle, the body portion comprising a laminated sheet having an inner layer of an unstretched film, the unstretched film of the inner layer of the body portion and the unstretched films of the intermediate and inner layers of the bottom portion being fusion-bonded along a seam between the body portion and the bottom portion by heat sealing.

5. A bag containing a liquid or powdery material, the bag comprising a penetrable portion to be pierced with a tubular or hollow needle for delivering the material out of the bag, the penetrable portion comprising a laminated sheet having an outer layer of an unstretched film, an intermediate layer including at least one of a calendered film and a stretched film, and an inner layer of an unstretched film, wherein a peeling strength between the outer layer and the intermediate layer is 0.0490 to 3.4323 N/15 mm width, and a peeling strength between the intermediate layer and the inner layer is 0.0490 to 3.4323 N/15 mm width.

6. A bag as set forth in claim 5, which is of a self-supporting type having an outwardly bulged bottom portion and a body portion, the bottom portion serving as the penetrable portion to be pierced with the needle, the body portion comprising a laminated sheet having an inner layer of an unstretched film, the unstretched film of the inner layer of the body portion and the unstretched film of the inner layer of the bottom portion being fusion-bonded along a seam between the body portion and the bottom portion by heat sealing.

* * * * *